US006648166B2

(12) United States Patent
Levy

(10) Patent No.: US 6,648,166 B2
(45) Date of Patent: Nov. 18, 2003

(54) FOLDING STORAGE ASSEMBLY

(75) Inventor: Ronny Levy, Ha'Ayin (IL)

(73) Assignee: Zag Industries Ltd., Rosh Ha'ayin (IL)

( * ) Notice: Subject to any disclaimer, the term of this patent is extended or adjusted under 35 U.S.C. 154(b) by 109 days.

(21) Appl. No.: 09/907,959

(22) Filed: Jul. 19, 2001

(65) Prior Publication Data

US 2003/0015445 A1 Jan. 23, 2003

(51) Int. Cl.[7] ..... B65D 6/06
(52) U.S. Cl. ..... 220/520; 206/373; 220/522
(58) Field of Search ..... 206/372, 373, 206/745–750, 751–755; 220/520, 522; 312/902

(56) References Cited

U.S. PATENT DOCUMENTS

| | | | | | |
|---|---|---|---|---|---|
| 2,541,890 | A | * | 2/1951 | Schaperkotter et al. | 220/522 |
| 2,558,124 | A | * | 6/1951 | Burden | 220/520 |
| 2,936,066 | A | * | 5/1960 | Meksula | 220/520 |
| 3,113,817 | A | * | 12/1963 | Imel | 220/520 |
| 3,310,905 | A | * | 3/1967 | Davis et al. | 220/520 |
| 4,129,346 | A | * | 12/1978 | Hofman | 312/902 |
| 4,561,705 | A | | 12/1985 | Schafer | |
| 4,643,494 | A | | 2/1987 | Marleau | |
| 4,998,616 | A | | 3/1991 | Hillinger | |
| 5,054,669 | A | | 10/1991 | Zimbardi et al. | |
| 5,114,007 | A | | 5/1992 | Chen | |
| 5,366,071 | A | * | 11/1994 | Laszlo | 206/373 |
| 5,984,441 | A | | 11/1999 | Stokhuijzen | |
| 6,062,385 | A | | 5/2000 | Cho | |

* cited by examiner

*Primary Examiner*—Jim Foster
(74) *Attorney, Agent, or Firm*—Pillsbury Winthrop LLP

(57) ABSTRACT

A portable storage assembly includes a central support structure and a container assembly comprising a storage container and a cover member. The container assembly is movable between access and storage positions with respect to the central support structure. When the container assembly is in its access position, the storage container is in its access position and the cover member is movable into its open position and when the cover member is in its closed position, the container assembly can be moved into its storage position in which the storage container is in its storage position with respect to the central support structure. The central support structure holds the cover member closed when the container assembly is in its storage position. A locking assembly releasably locks the container assembly in its storage position. A handle is connected to the central support structure for carrying assembly.

19 Claims, 5 Drawing Sheets

FOLDING STORAGE ASSEMBLY

FIELD OF THE INVENTION

The invention is generally related to storage assemblies and more particularly to portable folding storage assemblies for storing and carrying a plurality of items.

BACKGROUND OF THE INVENTION

Most portable storage boxes (such as, for example, toolboxes used for storing tools and related items for various types of work such as carpentry, electrical work, sewing and various hobbies) generally comprise a relatively large, box-like container having a pivotally mounted cover or lid. The relatively large container provides a relatively deep storage space. Often, a lower portion of this storage space is used to store relatively large tools (such as hammers, wrenches, screwdrivers, scissors, pliers and the like) and a removable tray-like structure is disposed in the upper portion of the storage space. The tray is a relatively shallow container that can be used to store smaller items (such as pencils, retractable rules, fasteners and the like).

This arrangement is disadvantageous for several reasons. For example, workers often have to use may small items (such as of fasteners of various sizes) while working. A carpenter may have to use nails or screws of various sizes, for instance, and a person who is sewing may use pins, buttons and like items of various sizes while working. Although the storage area of the tray may be subdivided into a few small compartments which can be used to organize some of the small items used by the worker, the tray arrangement often does not provide a sufficient number of compartments or an optimal arrangement of compartments for many tasks. Another disadvantage of this type of toolbox is that the tray must be removed from the storage box to provide access to the relatively large items at the bottom of the storage space.

There is a need for a portable storage box that can provide a large number of small compartments to accommodate and organize a large number of small items, that can also provide relatively large storage spaces for relatively large tools, and that can provide easy access and well organized access to all of the storage space provided by the storage box.

SUMMARY OF THE INVENTION

The need identified above is met by a portable folding storage assembly for storing and carrying a plurality of items constructed according to the principles of the present invention. The storage assembly includes a central support structure constructed and arranged to be supported in a generally upright position on a level support surface and a container assembly. The container assembly includes a storage container and a cover member. The storage container provides an interior storage space and an access opening into the storage space. The storage container is mounted on the central support structure for movement with respect thereto between an access position and a storage position. The cover member is movable with respect to the storage container between a closed position in which the cover member is in covering relation with the access opening of the storage container to retain stored items within the storage space and an open position in which the cover member is moved away from the access opening of the storage container to allow items to be placed in and removed from the storage space of the storage container. The container assembly is movable between an access position and a storage position with respect to the central support structure. The container assembly is constructed and arranged such that (1) when the container assembly is in its access position, the storage container is in its access position and the cover member is movable into its open position and (2) when the cover member is in its closed position the container assembly can be moved into its storage position in which the storage container is in its storage position with respect to the central support structure. The central support structure is constructed and arranged such that when the container assembly is in its storage position, the central support structure is positioned to hold the cover member in its closed position with respect to the storage container. The storage assembly includes a locking assembly that is constructed and arranged to releasably lock the container assembly in its storage position. A handle is connected to the central support structure. The handle is manually engagable by a hand of a worker to enable the worker to carry the central support structure, particularly when the container assembly is in its storage position.

The storage assembly 10 further includes a plurality of drawers, each drawer providing a storage space for storing items therein. Each of the drawers is mounted in the central support structure for movement between open and closed drawer positions. The container assembly and the plurality of drawers are constructed and arranged such that 1) when the container assembly is in its access position the drawers are movable between their open and closed positions and such that 2) when the drawers are in their closed positions, movement of the container assembly into its storage position releasably locks each drawer in its closed position.

Other aspects, features and advantages of the present invention will become apparent from the following detailed description, the accompanying drawings and the appended claims.

DETAILED DESCRIPTION OF THE INVENTION

Figure 1:
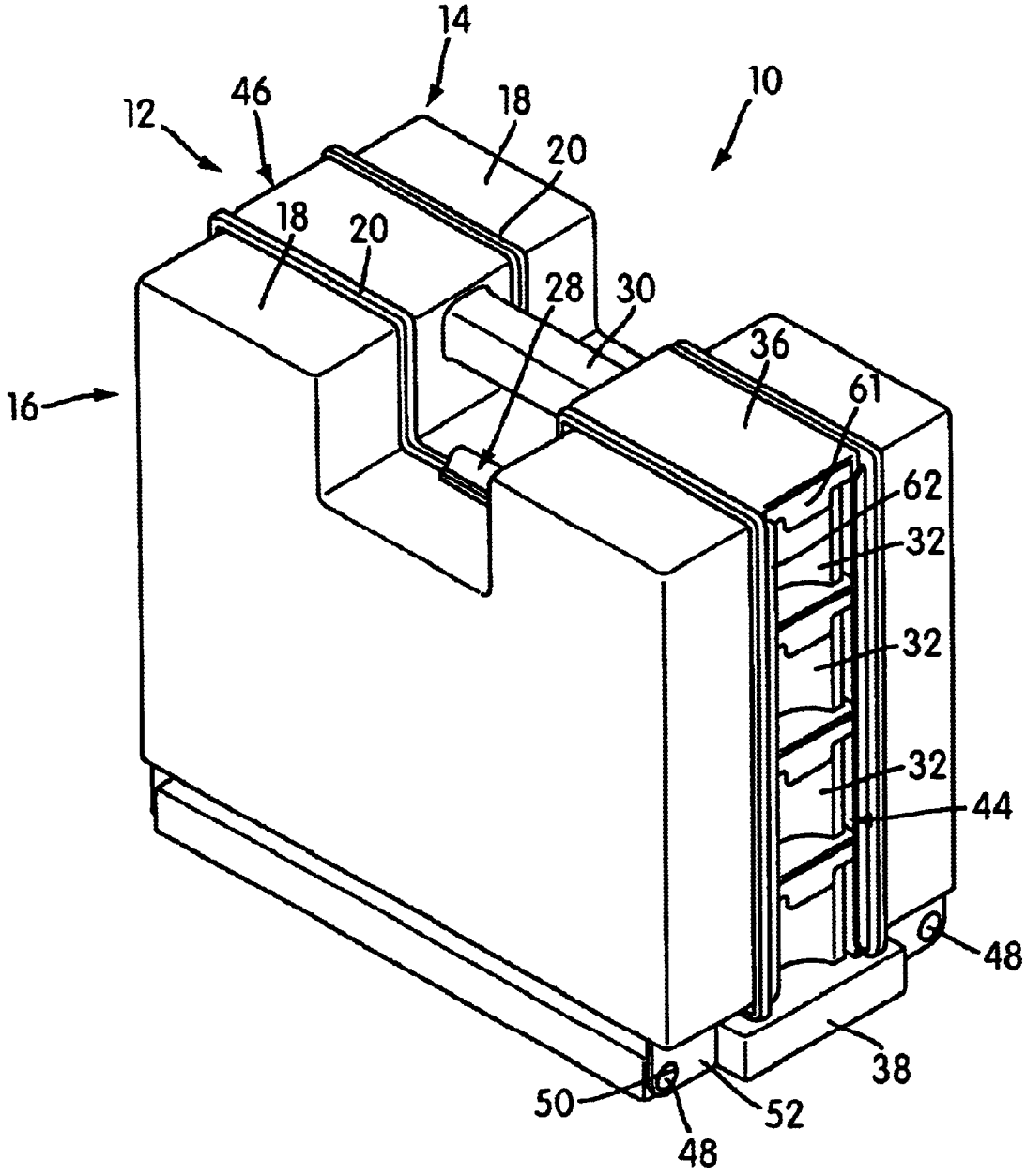
FIG. 1 shows a perspective view of an example portable folding storage assembly constructed according to the principles of the present invention, the storage assembly including a pair of container assemblies and a plurality of drawers mounted on a central support structure, the container assemblies being shown in their storage positions and the drawers being shown in their closed positions in FIG. 1.
Figure 2:
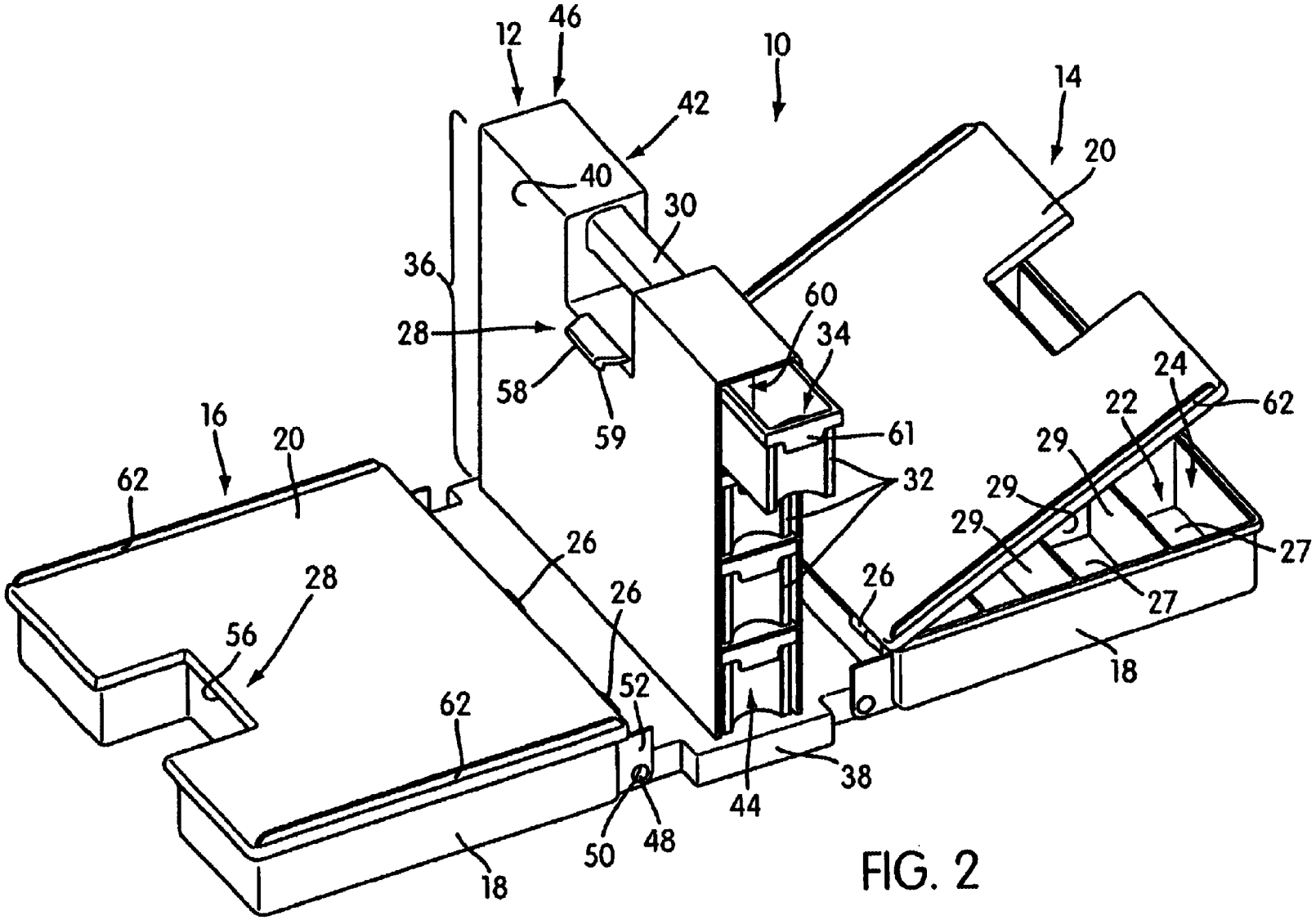
FIG. 2 is a view similar to FIG. 1 except showing each container assembly in its access position, one container assembly having a cover member thereof in a closed position and the other container assembly having the cover member thereof in a partially open position to show a plurality of compartments within the storage space thereof, and FIG. 2 further showing one of the drawers in a partially open position.

FIGS. 1 and 2 show an example of a portable folding storage assembly 10 constructed according to the principles of the present invention for storing, organizing and carrying a plurality of items. The storage assembly 10 includes a central support structure 12 constructed and arranged to be supported in a generally upright position on a level support surface and a pair of container assemblies 14, 16 movably mounted on the central support structure 12. The particular container assemblies 14, 16 that are shown to illustrate the principles of the invention are of similar construction to one another. Only container assembly 14 is considered in detail, but the construction and operation of container assembly 16 can be understood from this discussion. The container assembly 14 includes a storage container 18 and a cover member 20.

The storage container 18 provides an interior storage space 22 and an access opening 24 into the storage space 22. The storage container 18 is mounted on the central support structure 12 for movement with respect thereto between an access position (see FIG. 2) and a storage position (see FIG. 1). The cover member 20 is movable with respect to the storage container between a closed position (see FIG. 1, for example, or the container assembly 16 of FIG. 2) in which the cover member 20 is in covering relation with the access opening 24 of the storage container 18 to retain stored items (not shown in the figures) within the storage space 22 and an open position (the cover member 20 of container assembly 14 is shown partially open in FIG. 2) in which the cover member 20 is moved away from the access opening 24 of the storage container 18 to allow items to be placed in and removed from the storage space of the storage container. The cover member 20 may be movably attached to the storage container 18 for movement between open and closed positions with respect thereto. More specifically, in the example storage assembly 10 the cover member 20 is pivotally attached to the storage container 18 by a set of hinges 26.

The storage space of the storage container 18 of the container assembly 14 is divided into a plurality of compartments 27 by walls 29. The storage space of the storage container 18 (not shown) of the other container assembly 16 may also be divided into a plurality of compartments (by a similar wall arrangement, for example) for storing and organizing relatively small items or, alternatively, the storage container 18 may have a single, undivided storage space for holding relatively large items. The compartments 27 can be used for organizing a plurality of personal items stored in the storage space.

The container assembly 14 is movable between an access position (FIG. 2) and a storage position (FIG. 1) with respect to the central support structure 12. When the container assembly 14 is in its access position, the storage container 18 thereof is in its access position and the cover member 20 thereof is movable into its open position. When the cover member 20 is in its closed position, the container assembly 14 can be moved into its storage position (in which the storage container thereof is in its storage position with respect to the central support structure). When the container assembly 14 is in its storage position, the cover member 20 is positioned between the central support structure 12 and the storage container 18 on which it is mounted. This positioning holds the cover member 20 in its closed position with respect to the associated storage container 18. When the cover member 20 is in its closed position, the cover member 20 closes the top opening of each compartment 27, thereby preventing items in one compartment from moving into another compartment (when, for example, the container assembly is pivoted into its storage position or when the storage assembly 10 is placed on its side when both of the container assemblies thereof are in their storage positions).

A locking assembly 28 releasably locks the container assembly 14 in its storage position. A handle 30 is connected to the central support structure 12. The handle 30 is manually engagable by a hand of a worker to enable the worker to carry the storage assembly 10.

A plurality of drawers 32 are mounted in the central support structure 12 for movement between open and closed positions. Each drawer 32 provides a storage space 34 for storing items (not shown) therein. When the container assemblies 14, 16 are in their access positions, the drawers 32 are movable between their open and closed positions. When the drawers 32 are in their closed positions, movement of the container assemblies 14, 16 into their storage positions releasably locks (in a manner described below) the drawers 32 in their closed positions. The drawers 32 may be constructed to be removable from the central support structure 12 so that each drawer 32 provides a detachable container. One or more drawers 32 may be divided into a plurality of compartments to organize items stored within each drawer, or alternatively, each drawer 32 may include a single storage space 34 (as shown).

In the example storage assembly 10, the central support structure 12, each storage container 18, and each cover member 20 are each constructed of a suitable light weight, high strength molded plastic material, although any suitable material may be used in their construction. Each hinge 26 may be of integral plastic construction (as shown) or may be of any other suitable construction. Each hinge 26 may, for example, include integral plastic portions and/or metal hinge parts (such as a metal rod which forms the pivot axis of the hinge, for example). More particularly, the hinge halves may be integrally formed on the storage container and cover member, respectively, of plastic material or each hinge may be constructed entirely of metal parts which are secured to the plastic (or other material if another material is used in the construction) by appropriate fasteners such as rivets or the like.

The central support structure 12 includes an upper portion 36 and a lower base portion 38. The upper portion 36 generally defines two opposing sidewalls 40, 42 (sidewall 42 is not visible in the figures but its location is generally indicated with the arrow associated with reference number 42 in FIG. 2) and a pair of opposing ends 44, 46 (end 46 is not visible but is generally indicated by reference numeral 46). The base portion 38 is relatively wide and supports the upper portion 36 thereof in an upright position and supports the storage assembly 10 in an upright position on a level surface when the storage assembly is in its closed position (that is, when each container assembly 14, 16 is in its storage position).

The container assemblies 14, 16 of the example storage assembly 10 are mounted on opposite sides of the central support structure 12. The base portion 38 includes two pairs of integral plastic cylindrical projections 48 (only one pair member of each pair is visible in the figures) that are received within openings 50 formed in a pair of rearwardly projecting flanges or wall portions 52 integrally formed on the storage container 18 of each container assembly 14, 16. The cylindrical projections 48 define a pivot axis for the pivotal movement of the associated storage containers 18 with respect to the central support structure 12. Any other suitable arrangement can be used for pivotally mounting the storage container 18 of each container assembly 14, 16 on the base portion of the central support structure 12.

Thus, each storage container 18 is pivotally mounted to the central support structure 12 for movement between its storage and access positions. When a storage container 18 is in its access position, it extends outwardly from a lower portion of the central support structure and is supported by the level surface on which the storage assembly 10 is resting. When a storage container 18 is in its access position, it extends generally horizontally outwardly from the generally vertically extending central support structure 12. When a storage container 18 is in its storage position, it is generally in side-by-side relation with the associated side wall 40 or 42 of the central support structure. When the storage container 18 is locked in its storage position (by locking assembly 28), each cover member 20 is held in its closed position on the associated storage container 18 by the positioning of the storage container 18 and the central support structure 12 as aforesaid.

Each locking assembly 28 may be integrally formed of plastic (as shown) or, alternatively, may be of any suitable construction, including a separate mechanical assembly constructed of a metal or other appropriate material that is then attached to the plastic of the storage container and associated cover member. Each example locking assembly 28 includes an integral plastic locking flange 56 formed on the storage container 18 of each container assembly 16, 18 and a complementary flexible hook-like structure 58 integrally formed of plastic on the central support structure 12. A locking structure 59 integrally formed on the hook-like structure 58 releasably hookingly engages the associated locking flange 56 on the storage container to hold the associated container assembly 14 or 16 in its storage position and to hold the cover member 20 in its closed position when the associated container assembly is in its storage position.

The drawers 32 may be made of a plastic material or any other suitable material. The drawers 32 are slidably received in openings 60 formed in one or both ends 44, 46 of the upper portion 36 of the central support structure 12. Drawers 32 may be mounted in each end 44, 46 or, alternatively, in one end (such as end 32) of the central support structure 12. The drawers 32 may be of equal dimensions to one another (as shown) or may be of different lengths and/or widths and/or depths from one another. Each drawer 32 includes a handle 61 for opening and closing the drawer. A lip or flange structure 63 on opposite sides of each drawer may be slidably supported on a pair of flanges formed on opposite sides of the associated opening 60.

Each container assembly 14, 16 includes drawer locking structure (illustrated in the form of flanges 62 on each cover member 20) that holds the drawers 32 in their closed positions when one or both of the container assemblies 14, 16 are in their storage positions. This prevents the drawers 32 from falling out or opening, for example, when the storage assembly 10 is being carried.

Figure 3:
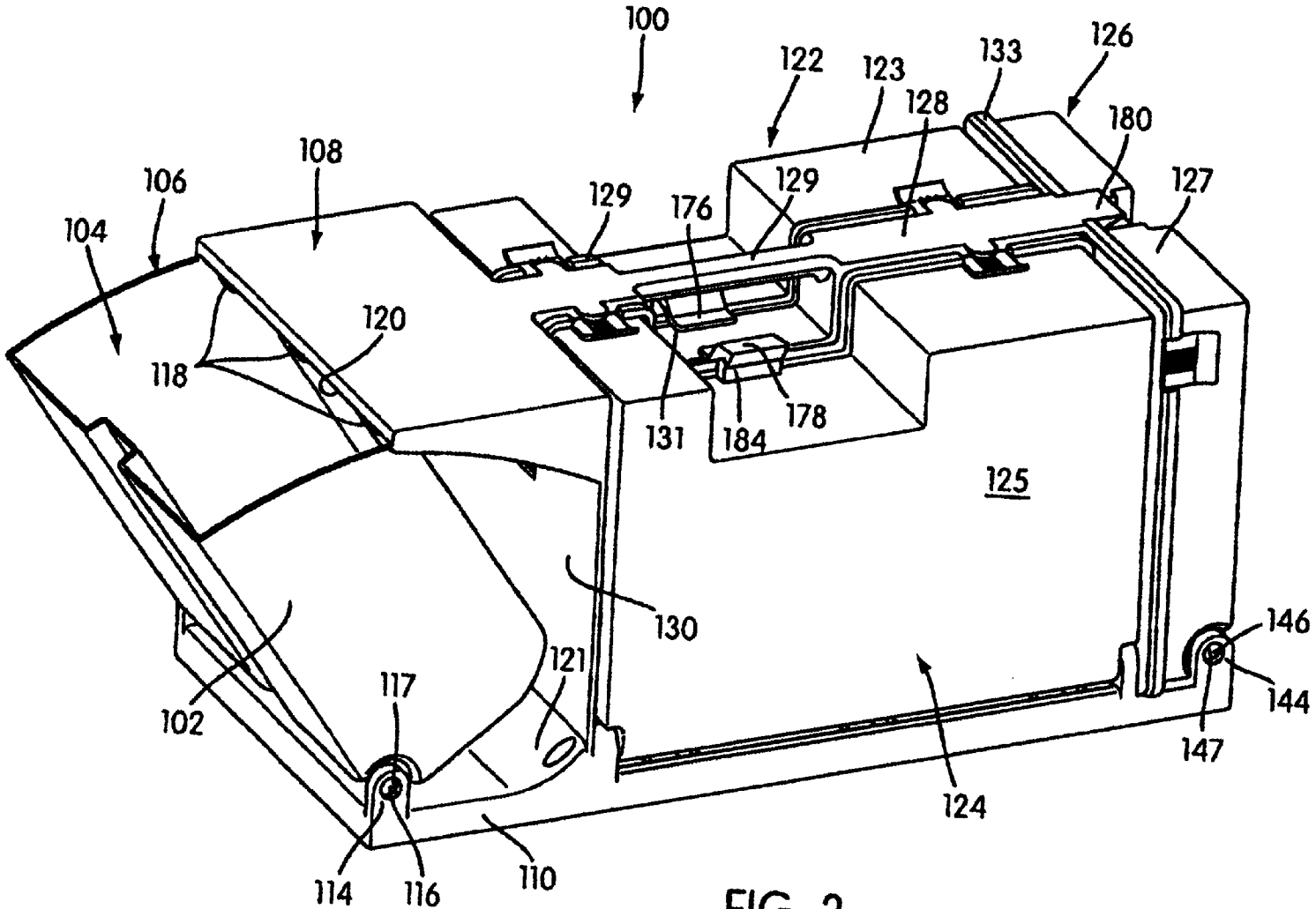
FIG. 3 shows a perspective view of another example portable folding storage assembly constructed according to the principles of the present invention, the folding storage assembly including the container assemblies, each shown in its storage position, and a storage bin shown pivoted into its access position.
Figure 4:
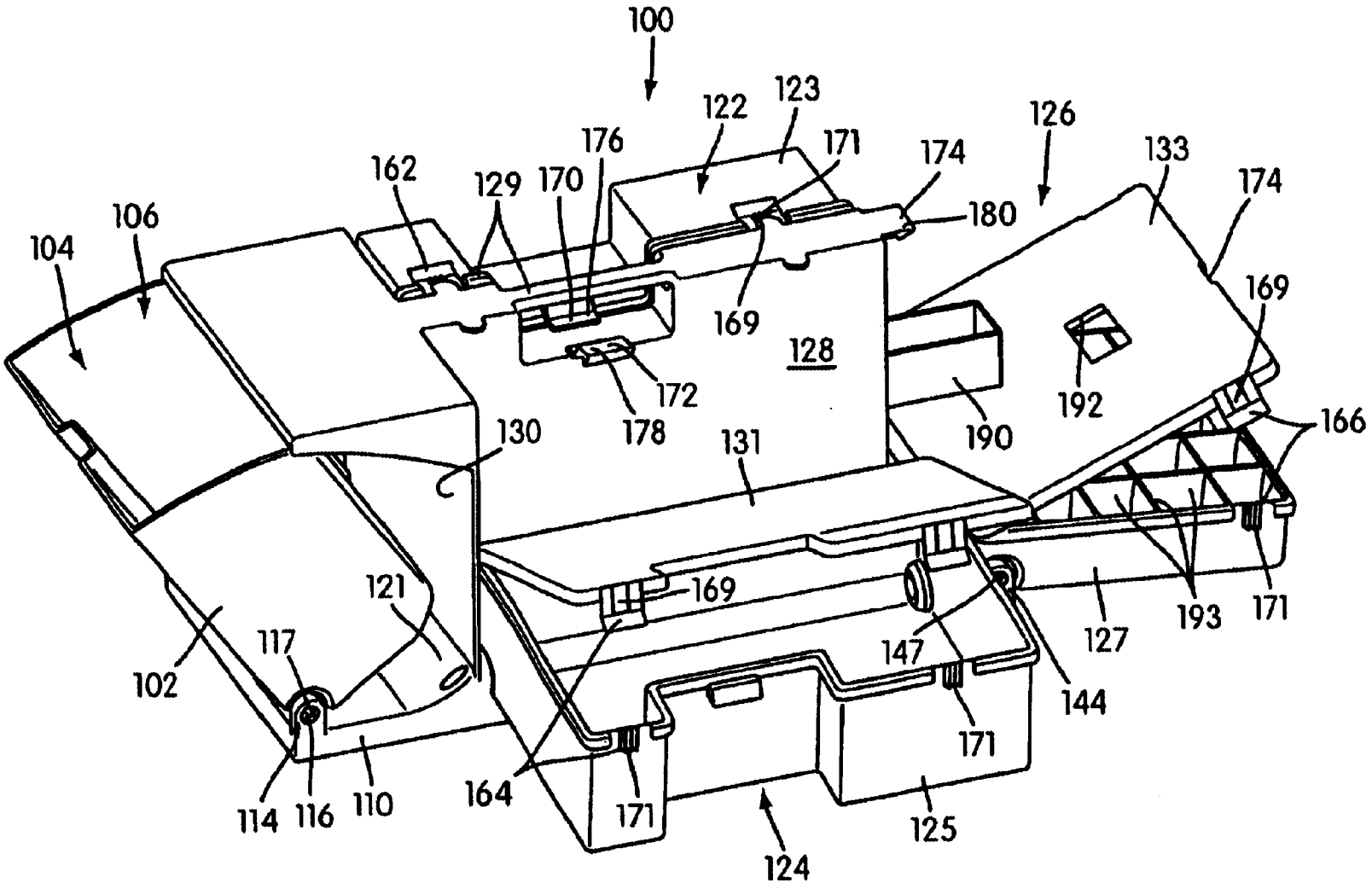
FIG. 4 is a view similar to FIG. 3 except showing two of the container assemblies of the storage assembly in their access positions and showing the respective cover members thereof partially open and showing a drawer of the storage assembly in its partially open position.
Figure 5:
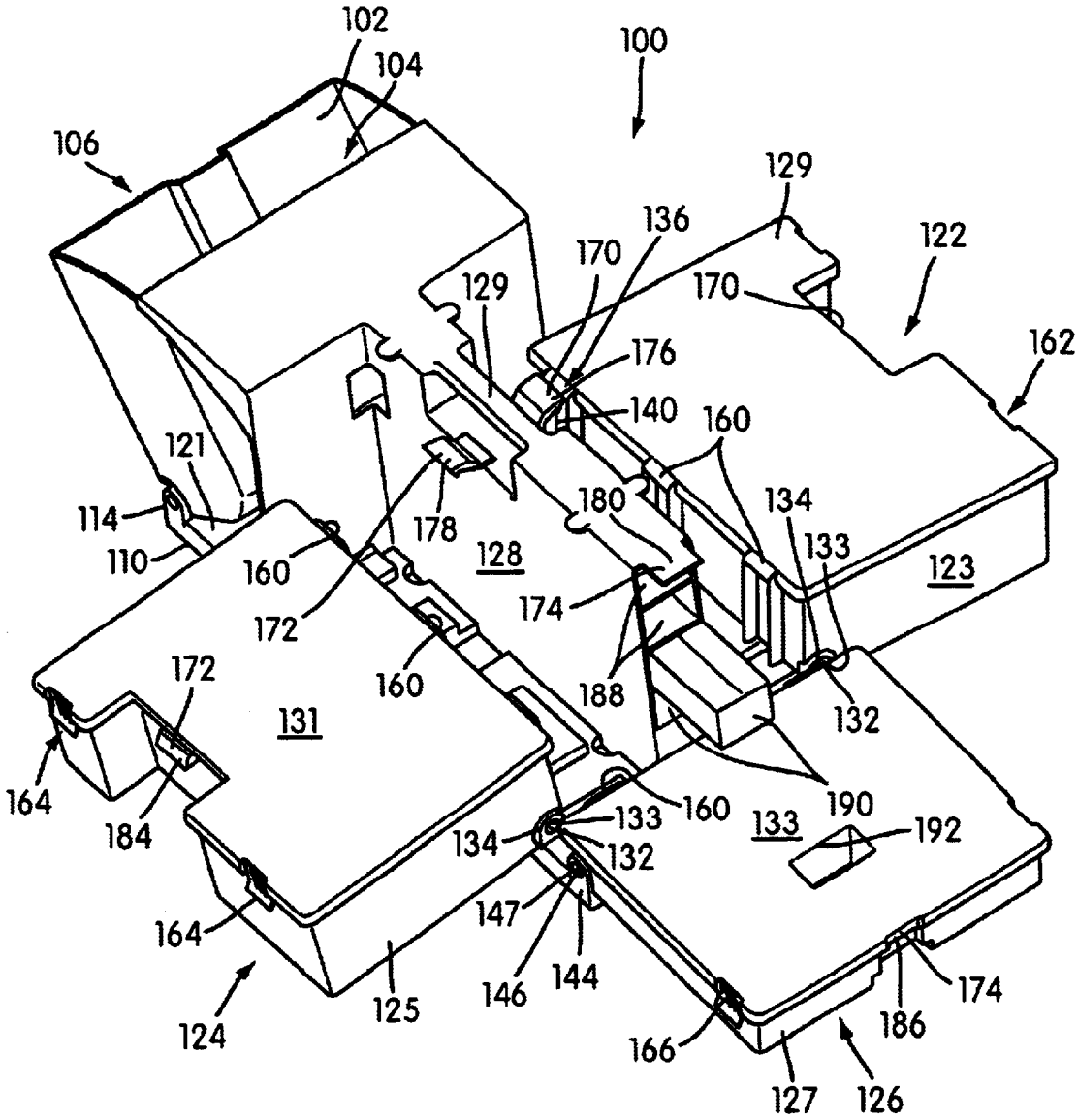
FIG. 5 is a view from another perspective of the portable folding storage assembly of FIG. 3 except showing all three of the container assemblies thereof in their access positions and showing the cover member of each container assembly in its closed position with respect thereto.

Another example of a storage assembly 100 is shown in FIGS. 3–5. The portable folding storage assembly 100 includes a storage bin 102 having an interior storage space 104 accessible through an access opening 106. The storage bin 102 is mounted on the central support structure 112 of the storage assembly 100 for movement between an access position (see FIG. 3, for example) and a storage position (not shown). The central support structure 112 includes covering structure generally designated 108 constructed and arranged to cover the access opening 106 of the storage bin 102 when the storage bin 102 is pivoted back into its storage position. A lower portion of the storage bin 102 is pivotally mounted to the central support structure 112 for movement between the access position and the storage position thereof. More specifically, a bottom wall portion 110 of the central support structure 112 includes a pair of flanges 114 that are used to pivotally mount the storage bin 102 to the central support structure 112. More specifically, a cylindrical projection 116 is received in an opening 117 formed in each flange 114.

The central support structure 112 further includes storage bin support structure (in the form of a plurality of downwardly extending flanges 118 formed the covering structure 108) that is constructed and arranged to limit the pivotal opening movement of the storage bin 102 from its storage position into its access position. The storage bin support structure 118 engages a back wall portion 120 of the storage bin 102 and thereby holds the storage bin 102 at an angle that provides convenient access to the items stored in the storage space 104 thereof through the access opening 106 of the bin while preventing the storage bin 102 from pivoting outwardly from the central support structure far enough to cause items stored therein to falling out or be "dumped" on the ground. The storage assembly 100 may optionally include a cushion-like pad of material 121 that cushions the impact of the movement of the storage bin 102 back into its storage position. The storage assembly 100 may optionally include a locking assembly (not shown) that locks the storage bin 102 in its storage position. This is generally not required because the weight of the items in the storage bin 102 are sufficient to keep the storage bin 102 in its storage position. The storage bin 102 is also angled outwardly far enough in its access position to that the weight of the items in the storage bin 102 keeps the storage bin 102 in its access position until the worker manually affirmatively pushes the bin back into its storage position.

The storage assembly 110 further includes a first, second and third container assembly, 122, 124, and 126, respectively. Each container assembly includes a storage container 123, 125, 127, respectively, and an associated cover member 129, 131, 133, respectively. Each container assembly 122, 124, 126 is mounted on the central support structure 112 for movement between an access position and a storage position. More specifically, the central support structure 112 includes the bottom wall portion 110, a central upwardly projecting portion 128 and an end wall portion 130. The end wall 130 and the central portion 128 extend integrally upwardly from the bottom wall portion 110. The end wall 130 is integrally connected to one end of the central portion 128. The covering structure 108 extends integrally outwardly from an upper portion of the end wall 130. A handle 129 is integrally formed at a top portion of the central support structure for lifting and carrying the assembly 100.

The container assembly 122 is pivotally mounted to the central support structure 112 at one end by a projection 132 (integrally formed on the storage container 123 or provided by a rivet or other fastener) that extends through an opening 133 in an upwardly extending flange 134 integrally formed on the bottom wall 110. The assembly 122 is pivotally mounted with respect to the end wall 130 by a cylindrical structure (not shown) that extends into an opening (not shown but similar to the opening 137 shown in FIGS. 3 and 4, for example) in the central support structure 112. The outwardly projecting support structure may be provided by a fastener such as a rivet or may be a cylindrical structure integrally formed on the storage container 123. The container assembly 124 is pivotally mounted to the central support structure 112 on the opposite side thereof using a similar arrangement.

The container assembly 126 is pivotally mounted to the central support structure 112 by means of a pair of flanges 144 that extend integrally upwardly from the bottom wall 110 of the central support structure 112 and an associated pair of cylindrical or rod-like projections 146 which could be integrally formed on the container structure 127 of the container assembly 126 or which could be provided by rivets or like fasteners. The projections 146 are pivotally mounted within openings 147 formed in the respective flanges 144.

In the example storage assembly 100, the central storage structure 112, and each container assembly 122, 124, 126 is constructed of a molded plastic, although any suitable material (metal, etc.) may be used in their construction. Each cover member 129, 131, 133, is pivotally attached to the associated storage container 123, 125, 127 by a set of integral plastic hinges 160 (although any appropriate hinge structure may be used). When each cover member is closed, each cover member 129, 131, 133 is releasably locked in its closed position on the associated storage container 123, 125, 127 by a pair of cover locking assemblies 162, 164, 166, formed on the three container assemblies, respectively. Each cover locking assembly 162, 164, 166 is comprised of an integral plastic flexible member 168 (formed on the associated cover member) that includes a central opening 169 that releasably engages associated integral plastic projections 171 (in the form of outwardly projecting wedge shaped "fins" or wall structures) formed on the associated storage container.

Each container assembly 122, 124, 126 is releasably locked in its storage position with respect to the central support structure 112 by an associated locking assembly 170, 172, 174. The locking assemblies 170, 172 are each comprised of a flexible locking member 176, 178, 180, respectively, integrally formed on the central support structure 112 and an associated flange structure 182, 184, 186 integrally formed on the storage container of the associated container assembly 122, 124, 126.

The central portion 128 of the central support structure 112 includes a plurality of openings 188 for slidably mounting a plurality of drawers 190 therein. When the container assembly 126 is releasably locked in its storage position, the drawers 190 are retained in their closed positions to prevent accidental opening movement of the drawers 190 during, for example, transport of the storage assembly 100. The container assembly 126 also includes an opening 192 that can be used as, for example, a handle to facilitate moving the container assembly between its access and storage positions.

The storage bin 102 provides a single large storage space for relatively large tools or other items. The storage containers 123, 125, 127 of the other container assemblies 122, 124, 126 may be divided into compartments by integral plastic wall structure 193 (see storage container 127 of container assembly 126 in FIG. 4, for example) or may have a single, noncompartmentalized storage position (see storage container 125 of container assembly 124 in FIG. 4, for example).

It can be understood that the storage assemblies 10, 110 shown in the drawings and described above are intended to illustrate and teach the concepts of the invention only, and are not intended to limit the scope of the invention to the example embodiments illustrated. For example, it is contemplated to provide a storage assembly similar to the storage assembly 10 except including only one container assembly mounted to the central support structure (instead of a pair of container assemblies as shown in, for example, FIG. 1). Storage assembly 10 in FIG. 2, for example, may include a structure that presents the pivotal movement of each container assembly in its opening direction beyond the horizontal (or "90 degree" position with respect to the generally vertically extending portion 128 of the central support structure 12) shown in FIG. 2. In this embodiment, a worker would be able to lift the storage assembly 10 off the ground (using the handle 30, for example) and the storage containers 18 would remain in their horizontal positions, thereby preventing the contents of each container from spilling on the ground.

A greater or lesser numbers of container assemblies and/or storage bins may be provided in a storage assembly then is illustrated in the example embodiments 10, 110.

It can be appreciated that the foregoing preferred specific embodiments of the invention have been shown and described for the purpose of illustrating the structural and functional principles of the present invention only and are subject to change without departing from such principles. Therefore, this invention includes all modifications, alterations and substitutions encompassed within the spirit and scope of the appended claims.

What is claimed is:

1. A portable folding storage assembly for storing and carrying a plurality of items, said storage assembly comprising:

a central support structure constructed and arranged to be supported in a generally upright position on a level support surface, and further comprising a plurality of drawers, each drawer providing a storage space for storing items therein, each of said drawers being mounted in the central support structure for movement between open and closed drawer positions;

a container assembly comprising a storage container and a cover member, said storage container providing interior storage space and an access opening into said storage space, said storage container being mounted on said central support structure for movement with respect thereto between an access position and a storage position, said cover member being movable with respect to the storage container between a closed position in which the cover member is in covering relation with the access opening of the storage container to retain stored items within the storage space and open position in which the cover member is moved away from the access opening of the storage container to allow items to be placed in and removed from the storage space of the storage container;

said container assembly being movable between an access position and a storage position with respect to the central support structure, said container assembly being constructed and arranged such that 1) when the container assembly is in its access position, the storage container is in its access position and the cover member is movable into its open position and 2) when the cover member is in its closed position the container assembly can be moved into its storage position in which the storage container is in its storage position with respect to the central support structure, the central support structure being constructed and arranged such that when the container assembly is in its storage position, the central support structure is positioned to hold the cover member in its closed position with respect to the storage container;

said container assembly and said plurality of drawers being constructed and arranged such that 1) when said container assembly is in its access position the drawers are movable between their open and closed positions and such that 2) when the drawers are in their closed positions, movement of the container assembly into its storage position releasably locks the drawers in their closed positions;

a locking assembly constructed and arranged to releasably lock the container assembly in the storage position thereof; and a handle connected to the central support structure, said handle being manually engagable by a hand of a worker to enable the worker to carry the central support structure, particularly when the container assembly is in the storage position thereof.

2. A portable folding storage assembly as defined in claim 1, wherein said drawers are removable from said central support structure.

3. A portable folding storage assembly as defined in claim 1, wherein the storage space of one or more drawers is divided into a plurality of compartments constructed and arranged to organize items stored within each drawer.

4. A portable folding storage assembly as defined in claim 1, wherein said container assembly is a first container assembly, said folding storage assembly further comprising a second container assembly mounted on said central support structure for movement between an access position and a storage position in a manner similar to the first container assembly, the first and second container assemblies and said plurality of drawers being constructed and arranged such that 1) when said first and second container assemblies are in the access positions thereof the drawers are movable between their open and closed positions and such that 2) when the drawers are in their closed positions, movement of the first and second container assemblies into their respective storage positions releasably locks the drawers in their closed positions.

5. A portable folding storage assembly as defined in claim 4, wherein said first and second container assemblies are mounted on opposite sides of the central support structure from one another.

6. A portable folding storage assembly as defined in claim 1, wherein the storage space of the storage container is divided into a plurality of compartments for organizing a plurality of personal items stored in the storage space thereof, the storage compartments being constructed and arranged such that when the cover member thereof is in its closed position, items in one compartment are prevented by said cover member from moving into another compartment.

7. A portable folding storage assembly as defined in claim 1, wherein the storage container is pivotally mounted to the central support structure and wherein when the storage container is in its access position it extends outwardly from a lower portion of said central support structure and is supported by said level surface.

8. A portable folding storage assembly as defined in claim 1, wherein the cover member is movably attached to the storage container for movement between open and closed positions with respect thereto.

9. A portable folding storage assembly for storing and carrying a plurality of items, said storage assembly comprising:

a central support structure constructed and arranged to be supported in a generally upright position on a level support surface;

a container assembly comprising a storage container and a cover member, said storage container providing interior storage space and an access opening into said storage space, said storage container being mounted on said central support structure for movement with respect thereto between an access position and a storage position, said cover member being movable with respect to the storage container between a closed position in which the cover member is in covering relation with the access opening of the storage container to retain stored items within the storage space and a open position in which the cover member is moved away from the access opening of the storage container to allow items to be placed in and removed from the storage space of the storage container;

said container assembly being movable between an access position and a storage position with respect to the central support structure, said container assembly being constructed and arranged such at 1) when the container assembly is in its access position, the storage container is in its access position and the cover member is movable into its open position and 2) when the cover member is in its closed position the container assembly can be moved into its storage position in which the storage container is in its storage position with respect to the central support structure, the central support structure being constructed and arranged such that when the container assembly is in its storage position, the central support structure is positioned to hold the cover member in its closed position with respect to the storage container;

a locking assembly constructed and arranged to releasably lock the container assembly in the storage position thereof;

a handle connected to the central support structure, said handle being manually engagable by a hand of a worker to enable the worker to carry the central support structure, particularly when the container assembly is in the storage position thereof; and a storage bin having an interior storage space accessible through an access opening, said storage bin being mounted on said central support structure for movement between an access position and a storage position, said central support structure including covering structure constructed and arranged to cover the access opening of the storage bin when the storage bin is in its storage position, wherein a lower portion of said storage bin is pivotally mounted to the central support structure for movement between the access position and the storage position thereof and wherein the central support structure further includes storage bin support structure constructed and arranged to limit the opening movement of the storage bin from its storage position into its access position, said storage bin support structure thereby holding the storage bin at an angle that provides convenient access to the items stored in the storage space thereof through the access opening thereof while preventing the storage bin from pivoting outwardly from the central support structure to cause items stored therein from falling out thereof.

10. A portable folding storage assembly as defined in claim 9, wherein said container assembly is a first container assembly, said folding storage assembly further comprising a second container assembly and a third container assembly mounted on said central support structure for movement between an access position and a storage position in a manner similar to the first container assembly.

11. A portable folding storage assembly as defined in claim 9, wherein the cover member is movably attached to the storage container for movement between open and closed positions with respect thereto.

12. A portable folding storage assembly, comprising:

a central support structure including a lower base portion and an upper portion supported on the lower base portion, the upper portion having a pair of opposed side walls defining a central storage space therebetween and opposed ends defining an access opening to the central storage space;

at least one container assembly supported by the lower base portion adjacent to a side wall of the central support structure and comprising a storage container providing interior storage space and an access opening into the storage space and a cover selectively movable over the access opening, wherein the container assembly is movable between an access position and a storage position and the cover is selectively movable when the container assembly is in the access position;

a locking assembly associated with the container assembly and the central support structure to releasably lock the container assembly in the storage position and close access to the central storage space; and a carrying handle connected to the central support structure.

13. A portable folding storage assembly as defined in claim 12, further comprising at least one drawer slidably disposed in the access opening to the central storage space.

14. A portable folding storage assembly as defined in claim 13, wherein the locking assembly includes a flange disposed on the at least one container assembly that overlaps the at least one drawer when the container assembly is in the storage position.

15. A portable folding storage assembly as defined in claim 12, wherein the locking assembly includes a latch.

16. A portable folding storage assembly as defined in claim 12, wherein the central support structure further comprises a storage bin support with a movement limiting structure, and further comprising a storage bin retained in the storage bin support and movable between a closed position and an open position defined by the movement limiting structure.

17. A portable folding storage assembly as defined in claim 16, further comprising a drawer slidably retained in the central storage space.

18. A portable folding storage assembly as defined in claim 12, wherein the at least one container assembly includes two container assemblies each mounted adjacent an opposed side wall of the central support structure.

19. A portable folding storage assembly as defined in claim 12, wherein the at least one container assembly includes three container assemblies, with two container assemblies mounted adjacent an opposed side wall of the central support structure and the third container assembly mounted on an end of the central support structure.

* * * * *